US006644780B2

(12) United States Patent
Lodal et al.

(10) Patent No.: US 6,644,780 B2
(45) Date of Patent: Nov. 11, 2003

(54) CARRIAGE WITH CLAMPING DEVICE FOR RELIABLE MOUNTING OF PRINTHEADS

(75) Inventors: John N. Lodal, Boise, ID (US); Erich E. Coiner, Poway, CA (US); Daiquiri R. Fouch, Boise, ID (US); Frederick Andrew Wolf, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/815,908

(22) Filed: Mar. 24, 2001

(65) Prior Publication Data

US 2002/0135634 A1 Sep. 26, 2002

(51) Int. Cl.[7] ..... B41J 2/14
(52) U.S. Cl. ..... 347/37; 347/49; 347/50
(58) Field of Search ..... 347/37, 49, 50

(56) References Cited

U.S. PATENT DOCUMENTS 4,755,836 A 7/1988 Ta et al.
4,907,018 A 3/1990 Pinkerpell et al.
5,646,665 A 7/1997 Swanson et al.
6,003,974 A * 12/1999 Wilson et al. ..... 347/50
6,196,665 B1 * 3/2001 Weeks ..... 347/49
6,296,345 B1 10/2001 Kline et al.

FOREIGN PATENT DOCUMENTS

JP 4-14454 A * 1/1992 ..... 347/50

* cited by examiner

*Primary Examiner*—Huan Tran

(57) ABSTRACT

A printer carriage has a chute for removably holding a print cartridge, and includes a set of datums on a forward portion of the chute for positioning the print cartridge. A spring-loaded clamp is movable by a handle between an open position which allows easy insertion and withdrawal of the print cartridge from the chute, and a closed position which applies a clamping force against a back wall of the print cartridge. The clamping force is preferably applied in both a forward and downward direction against a lower portion of the back wall to securely hold the print cartridge in the chute against the datums, and to provide conductive contact through a plurality of electrical interconnects between the carriage and the print cartridge. A method of installation and removal of a print cartridge employs access along a primarily vertical path through an open top of the chute. A printing system with the carriage and print cartridge preferably expels ink along an approximately horizontal path from an upstanding nozzle plate

29 Claims, 10 Drawing Sheets

CARRIAGE WITH CLAMPING DEVICE FOR RELIABLE MOUNTING OF PRINTHEADS

RELATED APPLICATIONS

BACKGROUND OF THE INVENTION

This invention relates generally to removable inkjet print cartridges, and more specifically to the proper positioning of print cartridges on a carriage.

Numerous performance and reliability problems can result if a removable print cartridge is not properly positioned, mounted and held by a carriage in a printing system. These may include inconsistent electrical connections, premature flex circuit failures, misplaced ink droplets on print media, and other resulting deficiencies such as ink deprime problems in the print cartridge which prevent satisfactory ink ejection from the print cartridge. Such reliability is especially important in low cost monochrome type printers which are used to print point-of-sale receipts.

The rapid acceleration and deceleration of a scanning carriage can also cause a print cartridge to rock or change position in a carriage unless it is securely clamped into a proper printing location against positional datums in a carriage chute.

When a print cartridge reservoir is depleted, proper cartridge removal and replacement should be self explanatory without having to follow complicated instructions The cartridge should be easily accessible for removal. The position of a newly installed cartridge should be repeatable each time without any necessary calibration. Partial installation should be easily avoided, and any handle should therefore tend to remain in either an open or close position rather than somewhere in between.

BRIEF SUMMARY OF THE INVENTION

A unique printing system has been developed which incorporates one or more print cartridges individually mounted in their own separate carriages which scan back and forth across media in a print zone The printer carriage has a cavity or chute for removable mounting of the print cartridge, and includes a set of support guides on a floor and a set of datums on a forward wall of the chute for positioning the print cartridge. A spring-loaded clamp is movable by a handle between a latched open position which allows easy insertion and withdrawal of the print cartridge from the chute, and a closed position which applies a clamping force against a back wall of the print cartridge. When the clamp is unlatched, a biasing spring pivots the clamp about an axis into the closed position such that a clamping force is applied in both a forward and downward direction against a lower portion of the back wall of the installed print cartridge to securely hold the print cartridge in the chute against the datums, and to facilitate conductive contact through a plurality of electrical interconnects between the carriage and the print cartridge.

A method of installation or removal of a print cartridge employs access along a vertical path through an open top of the chute when the clamp is in the open position. A printing system with the carriage and print cartridge expels ink along an approximately horizontal path from an upstanding nozzle plate while the clamp is in the closed position.

DETAILED DESCRIPTION OF PREFERRED EMBODIMENTS

Figure 1:
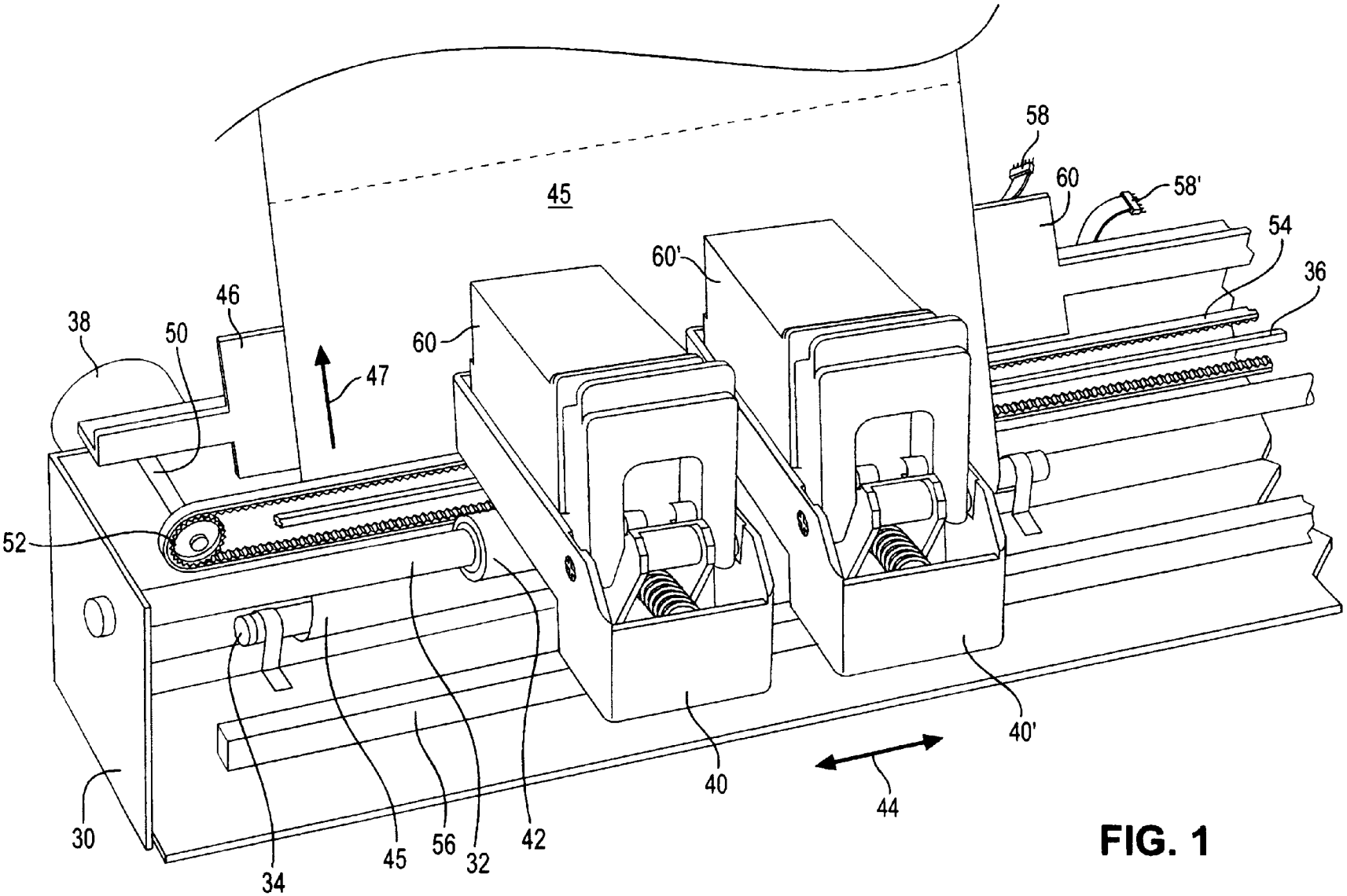
FIG. 1 shows a printer system incorporating an embodiment of the present invention with two carriage-mounted print cartridges.
Figure 2:
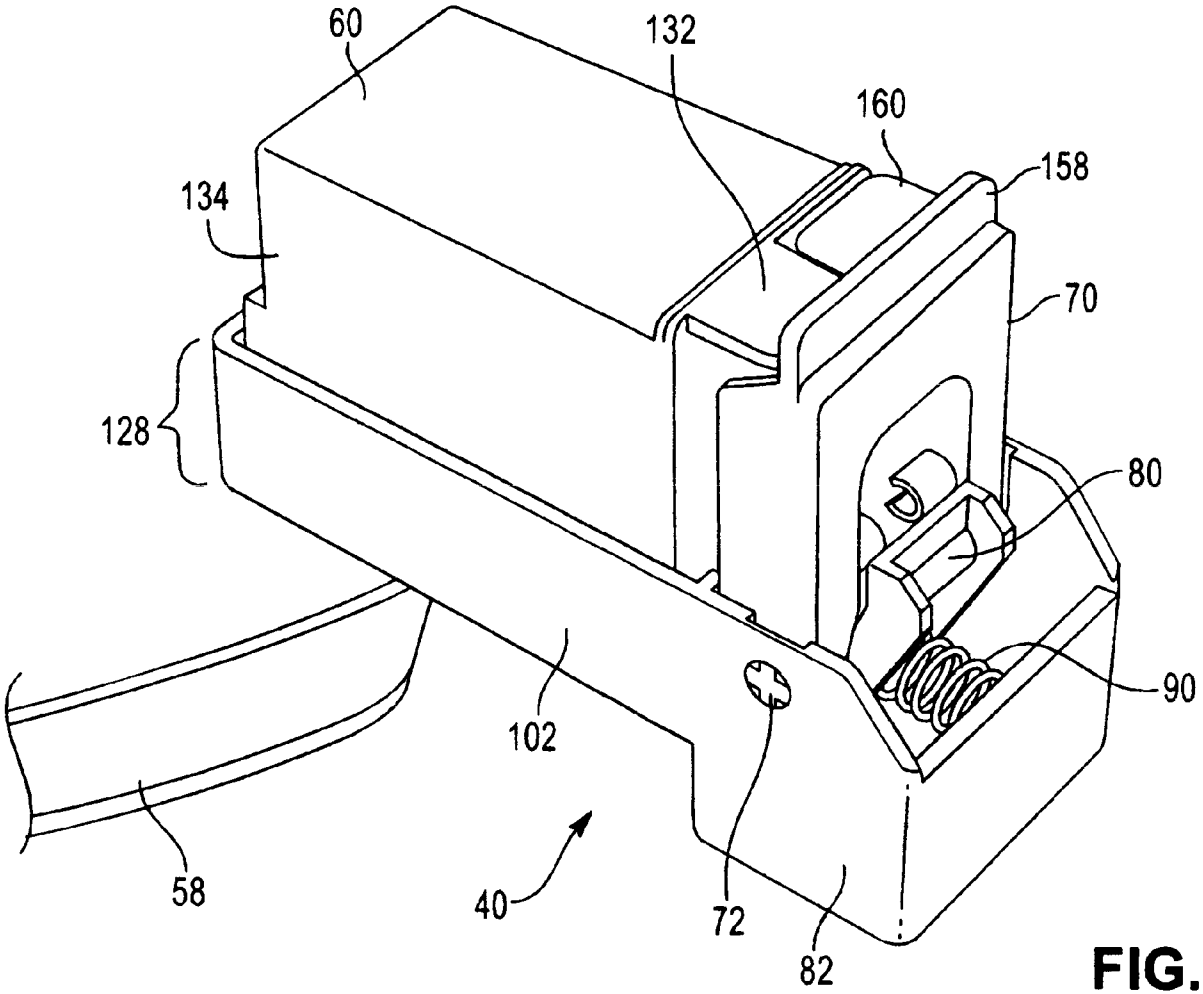
FIG. 2 is a top perspective view of a carriage-mounted print cartridge with a handle upright and a clamp on closed position.
Figure 3:
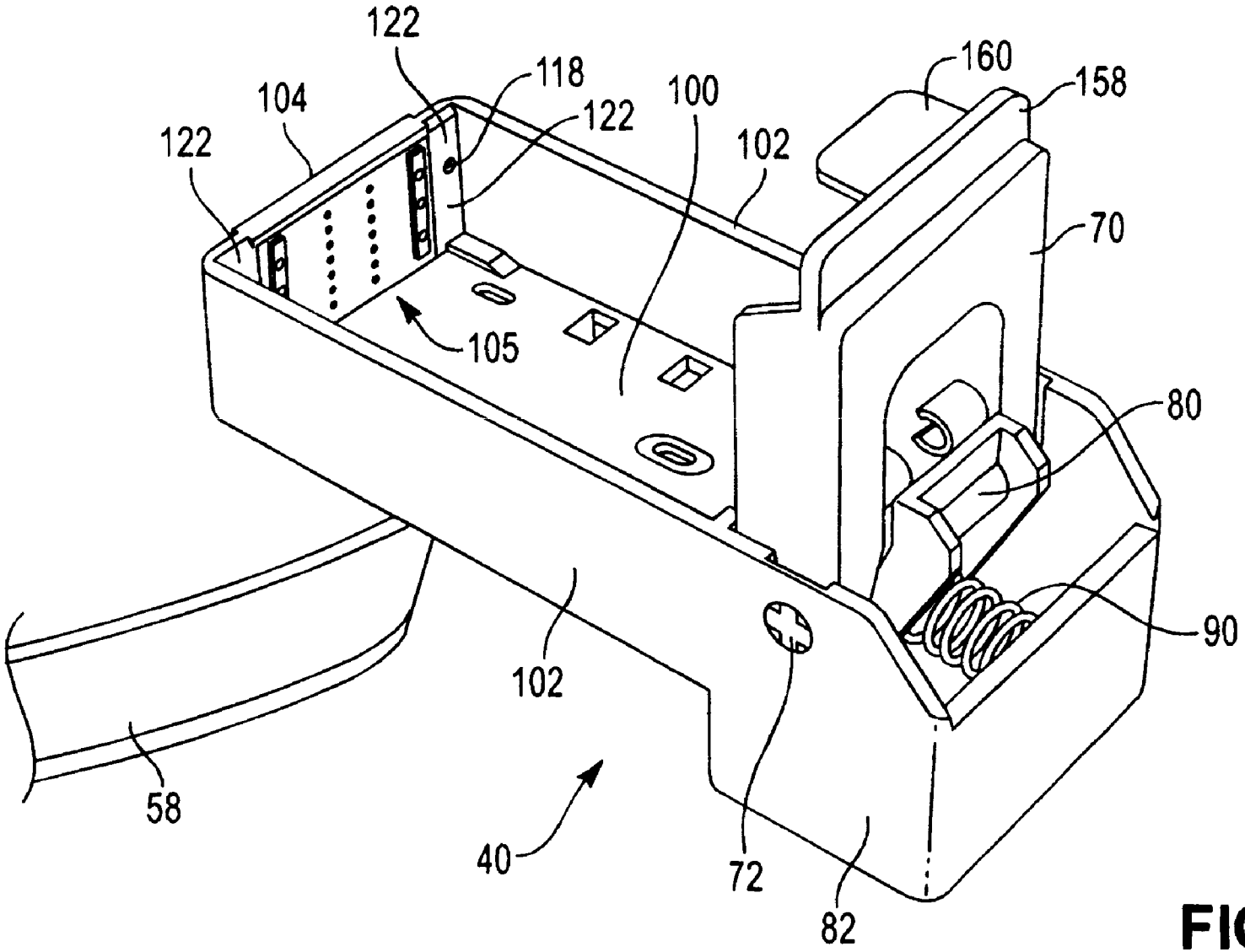
FIG. 3 is a top perspective view of the carriage without any print cartridge, with the handle upright and the clamp in closed position.
Figure 4:
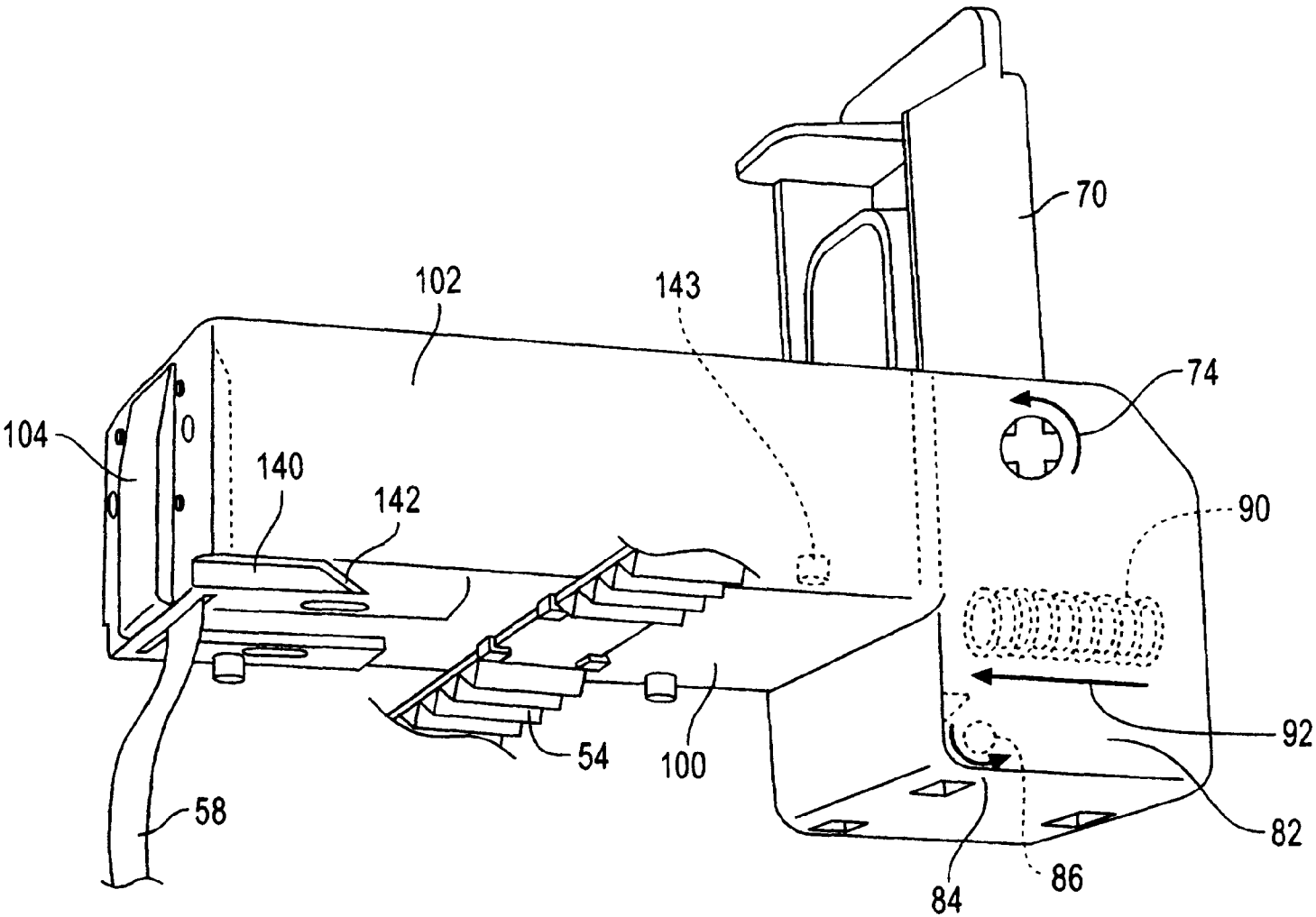
FIG. 4 is a side perspective view of the carriage of FIG. 3;, with a drive belt attached.

An exemplary printing mechanism as shown in FIG. 1 includes a frame, 30, carriage support bar 32, media guide bar 34, encoder strip 36, and carriage drive motor 38. A carriage member 40 may include a cylindrical bushing 42 which rides on the support bar 32 back and forth in a carriage scan direction 44 while media 45 is periodically advanced over a platen 46 in a media advance direction 47 through a print zone. The carriage drive motor 38 is typically mounted on a back of the frame 30 and rotates an axle 50 which carries a belt gear 52 which engages an inside toothed surface of a carriage drive belt 54. The left end of the encoder strip is cut away so show details of the carriage drive mechanism. In order to facilitate proper positioning of the carriage over the print zone, a guide bracket (not shown) may be attached at the bottom front of the carriage 40 to slide along a guide bar 56. Of course the unique carriage features described in more detail below can be utilized with any type of drive mechanism and support bar bearings as may be appropriate for the intended use of the printer, In its simplest form, the invention can be implemented with a single print cartridge 60 mounted in carriage 40 and connected through a flex circuit 58 to an printer control unit such as a computer, sales register, etc. However for greater efficiency and throughput, the invention contemplates additional print cartridges such as 60' with flex circuit 58' and mounted in their own carriage 40' which could be aligned with cartridge 40 for both passing over a same swath or alternatively be located in staggered relationship to print a double swath in a single pass. Although the features of the present invention are especially applicable for use with monochrome printheads, a person skilled in the art could implement the present invention with separate printheads each having a different color marking liquid, or even with tri-compartment print cartridges having three different types or different color liquids.

Also, although a preferred orientation of the printer carriage and print cartridge as shown in FIG. 1 currently provides a vertical platen with a nozzle plate ejecting marking liquid in an approximately horizontal direction onto the media, the unique carriage and cartridge system can also be used with print cartridges mounted over a horizontal platen having a nozzle plate ejecting marking liquid downwardly onto the media.

Figure 5:
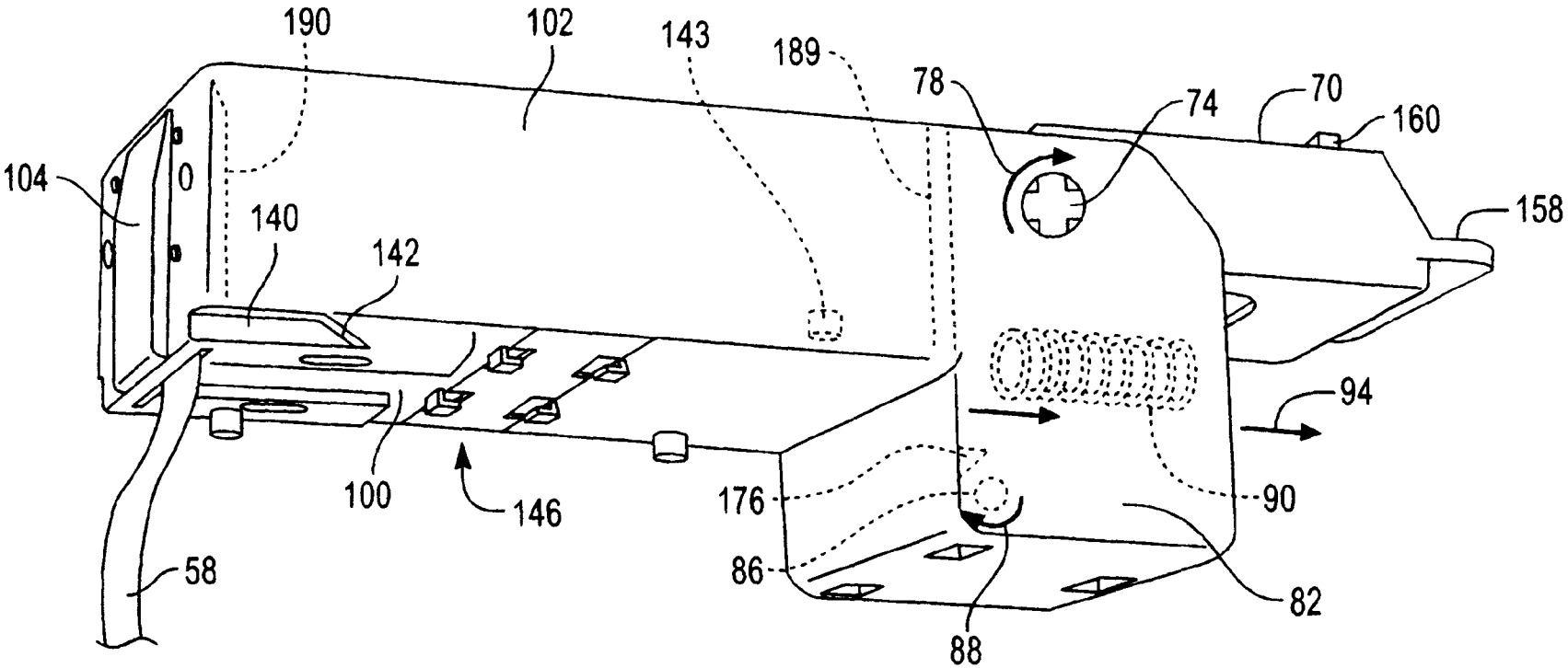
FIG. 5 is a side perspective view of the carriage of FIG. 3 without any print cartridge, with the handle down and the clamp in open position.
Figure 6:
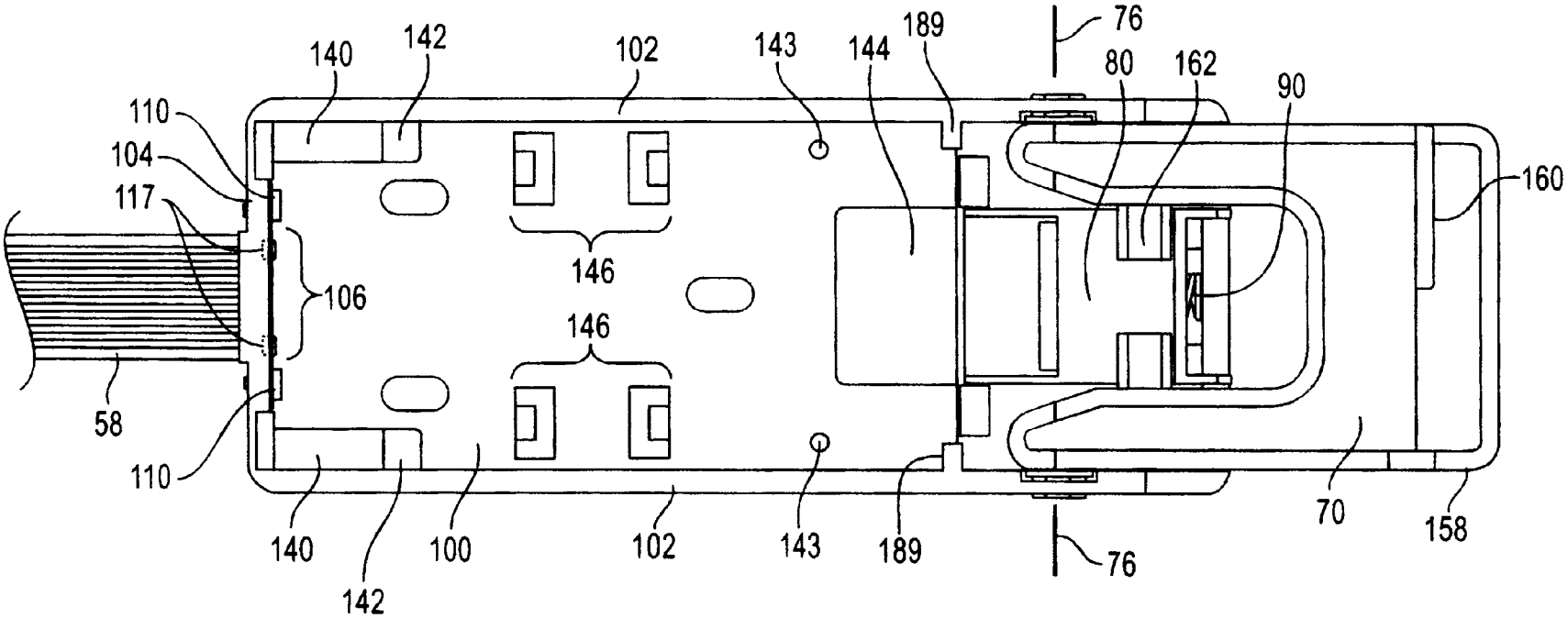
FIG. 6 is a top plan view of FIG. 5.

FIGS. 2–6 show additional features of the illustrated embodiment of the carriage 40, including a U-shaped handle 70 mounted on hubs 72 for rotation forwardly shown by arrow 74 on handle axis 76 to an upright position (see FIGS. 2, 3 and 4), as well as rotation rearwardly shown by arrow 78 to a horizontal position (see FIGS. 5 and 6). Such rotation of the handle back and forth through a one-quarter turn (approximately 90 degrees) controls pivotal movement of clamp 80 which is mounted inside a lower rear portion 82 of the carriage. Accordingly clamp 80 moves back a forth between open and closed positions as described more fully below by pivoting forwardly shown by arrow 84 on clamp axis 86 well as rearwardly shown by arrow 88. A biasing spring 90 applies a constant biasing force to the clamp in a generally forward direction 92 and is compressed in a rearward direction 94 when the clamp is retracted by the handle.

Figure 8:
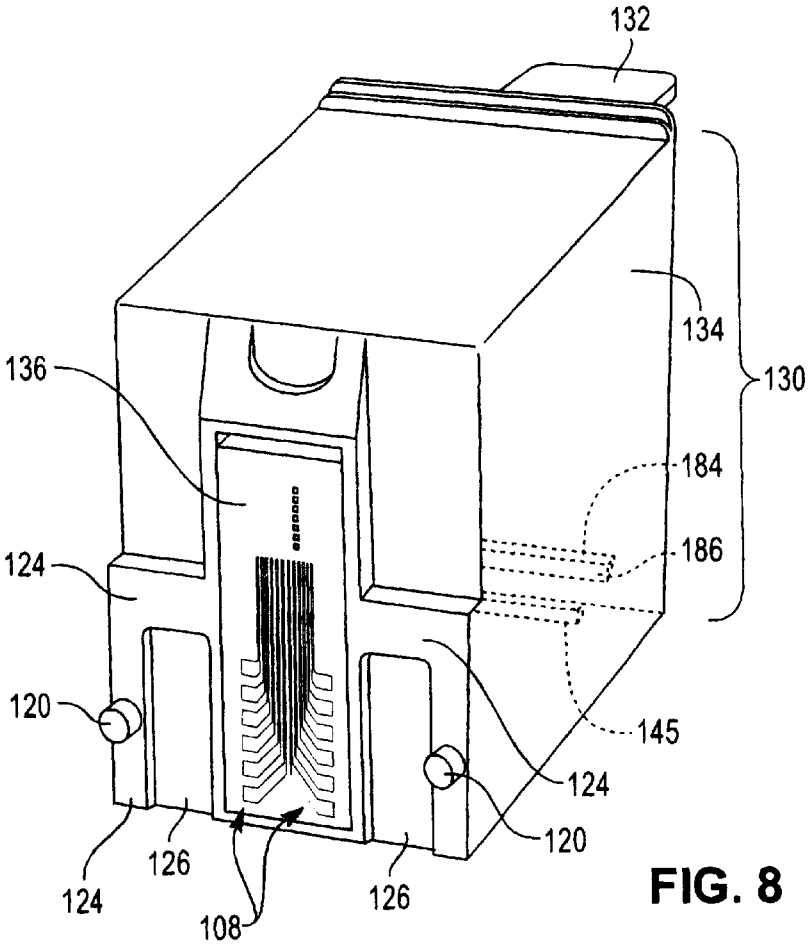
FIG. 8 is a front perspective view of the print cartridge of the previous figures.
Figure 7:
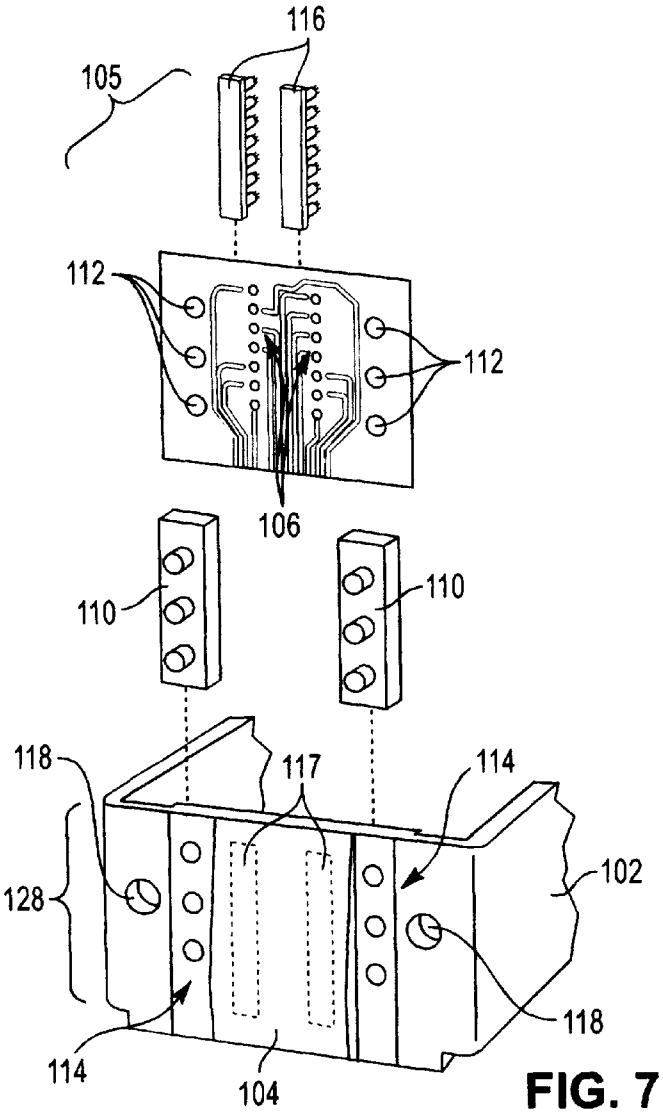
FIG. 7 is a perspective end view of a front wall of the carriage with an exploded view of its flex circuit assembly showing the reverse side of the signal pads.

The carriage 40 includes a floor 100, side walls 102 and front wall 104 which together form a cavity or chute with an open top for receiving the print cartridge 60. The front wall carries the flex circuit assembly 105 which includes flex circuit 58 with fourteen electrical interconnects 106 in a two-row pattern which matches the corresponding fourteen signal pads 108 located on a lower front face of the print cartridge which activate ejection of ink or other marking liquid from nozzle plate 136 (See FIGS. 7–8). The flex circuit assembly 105 also includes two retainers 110 each having three pins for passing through slightly enlarged matching flex circuit openings 112 and through matching front wall openings 114 sized for a snug press-fit attachment to the front wall.

The front face of the print cartridge also includes two elongated recesses 126 which accommodate the previously mentioned retainers when the print cartridge is installed in the carriage chute.

Other flex circuit assembly parts include two cushion members 116 having raised pyramid shaped bumps or projections respectively matching each electrical interconnect, with the cushion members sized to fit into similarly shaped flat bottom grooves 117 on the inside of the front wall with some expansion space in each groove provided by an encircling raised perimeter ledge. This is an improvement over prior open-ended grooves that allowed the cushion to creep or "inch worm" its way out of the open end of the groove. Also, if adequate lateral expansion space is not provided in the groove, two undesirable consequences occur. First, the connector cushion is much stiffer, thus requiring more clamping force to ensure that the print cartridge is properly located in the carriage chute, secondly, the clamping force varies much more depending on the tolerances. The groove feature described herein avoids these problems by incorporating a completely enclosed groove with sufficient width for expansion under pressure.

Figure 11:
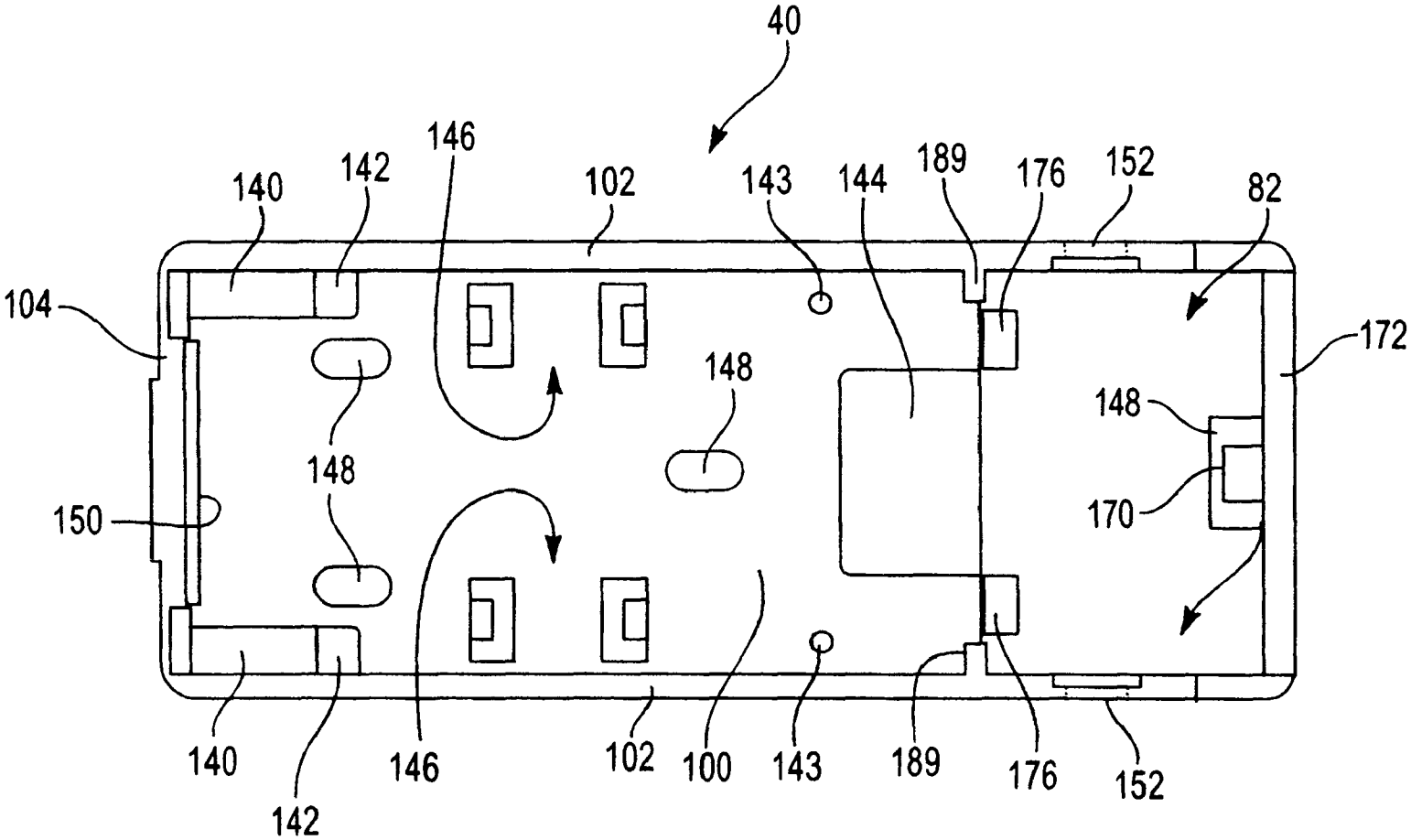
FIG. 11 is a top plan view showing a carriage with the handle, clamp, spring and flex circuit assembly removed

Additional structural features of the carriage and their function are best understood by reference to FIG. 11. The front wall 104 includes a set of positional datums which define horizontal, vertical and lateral position limits for the print cartridge generally and more importantly for the closely adjacent nozzle plate and electrical interconnects. This set of positional datums includes two holes 118 which are sized and located to receive datum bosses 120 on the lower front face of the print cartridge, and also includes two frictional surfaces 122 around the holes which engage matching areas 124 on the front face of the print cartridge.

The floor 100 of the carriage chute includes various support guides such as a pair of spaced apart ledges 140 in front corners with ramps 142, and a pair of spaced apart raised legs 143 toward the back adjacent side walls 102, and a central recess 144 which engages a bottom tab 145 on the print cartridge. These support guides facilitate the installation of the print cartridge in the carriage chute such that the aforementioned set of datums are properly aligned to assure proper predetermined forward, vertical, lateral and rotational positioning for the print cartridge in the carriage along with precise and secure alignment of the nozzle plate and electrical interconnects.

It is important to note that the aforesaid walls of the carriage chute are truncated and extend a distance 128 which is less than half the way up the front and rear heights 129, 130 of the print cartridge. This enables easy manual access to a print cartridge tab 132 and to the print cartridge walls 134 when installing or removing the print cartridge from the chute, and also exposes a nozzle plate 136 on the front face of the print cartridge for ejecting ink drops in an approximately horizontal path onto the print media Also the carriage is a unitary member molded from carbon fiber reinforced plastic. The carbon fiber makes the material conductive, thus providing an electric current path for electrostatic discharges (ESD). This prevents ESD from damaging the print cartridge.

Extending outwardly below the floor are two pair of L-shaped brackets 146 for receiving the carriage drive belt 54. Optional apertures 148 are located in the floor and also in the bottom of the rear chute portion 82 in order to provide easy attachments to carriage components such as support guide bushings, encoder strip, etc. A slot 150 is provided through floor 100 at the base of front wall 101 to allow the flex circuit 58 to pass through the floor to inside the carriage chute.

Figure 12:
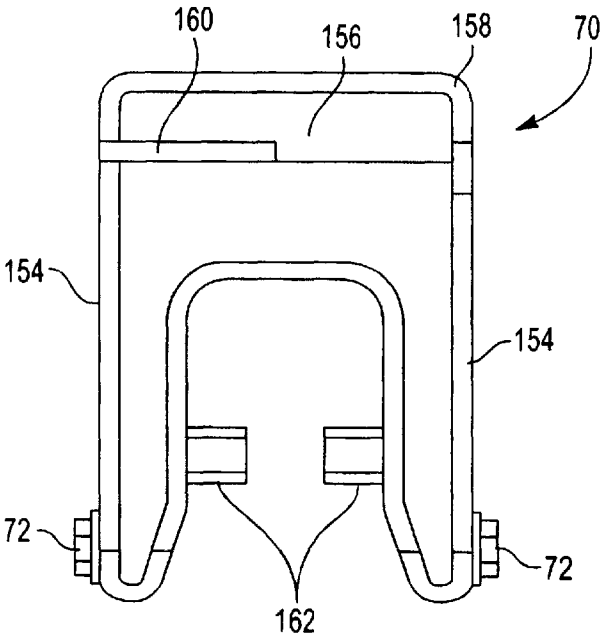
FIG. 12 is a end view of the handle.
Figure 13:
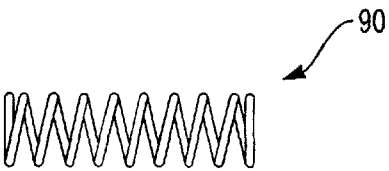
FIG. 13 is a side view of the spring.

FIGS. 12–15 show the individual parts which interact together inside the carriage to achieve the clamping and unclamping of the print cartridge. The handle 70 is made of a different color plastic from the carriage for easy user identification. Referring to FIG. 12 which shows a view of the front face of the handle 70, the handle is molded as if it were a single layer shaped to form the previously identified solid hubs 72 rotatably mounted in holes 152, spaced apart double layer arms 154 which join together at the top to form bridge 156 which carries upper grip 158 and forward tab 160. A pair of semi-circular hollow cams 162 extend inwardly from the arms 54, respectively with the outer convex cam surfaces facing rearwardly when the handle is in the upright position.

Figure 10C:
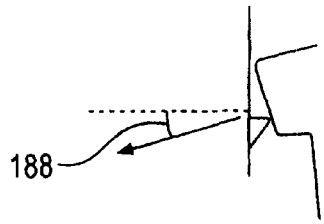
FIGS. 10A, 10B and 10C are schematic drawings showing operation of the handle and clamp when the print cartridge is being installed/removed, and is in clamped printing position.
Figure 10B:
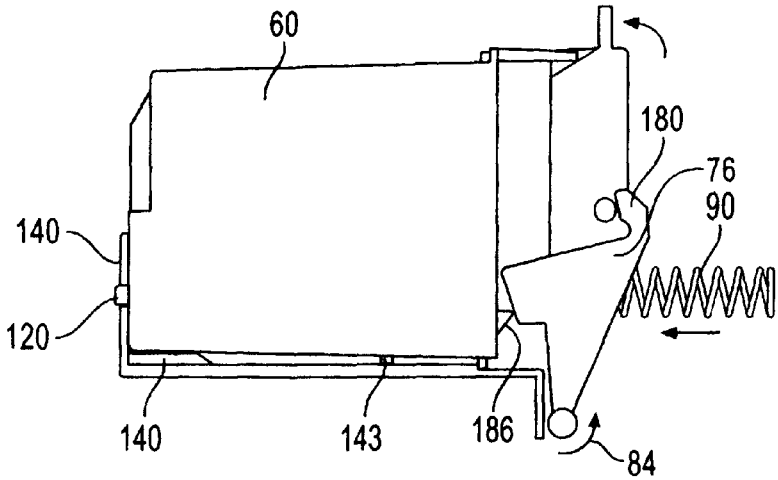
Figure 10A:
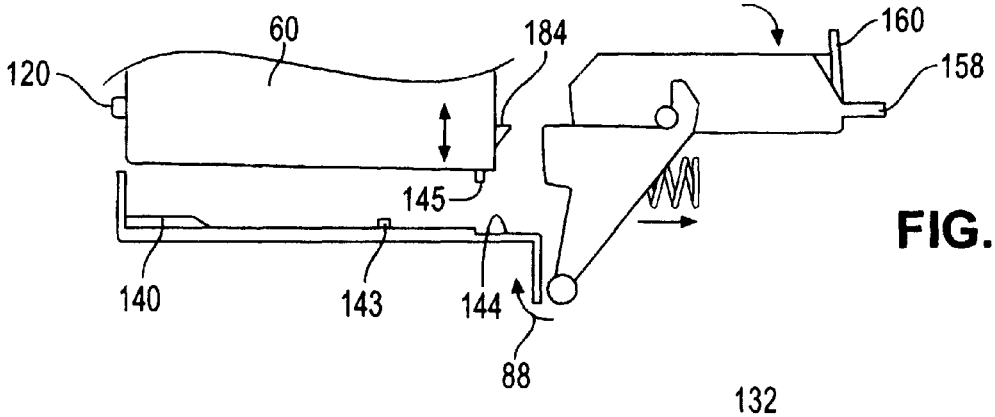
Figure 14:
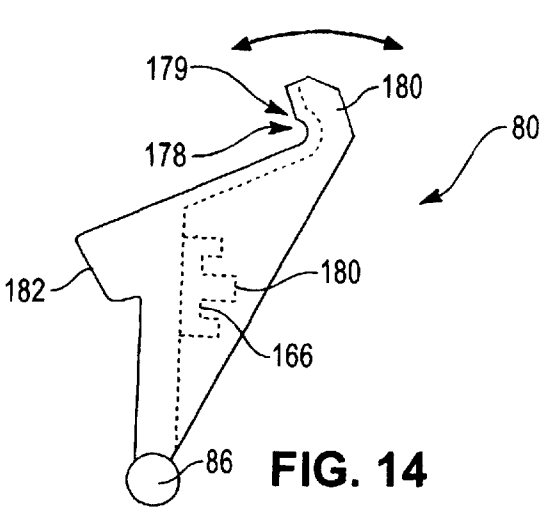
FIG. 14 is a side view of the clamp.
Figure 15:
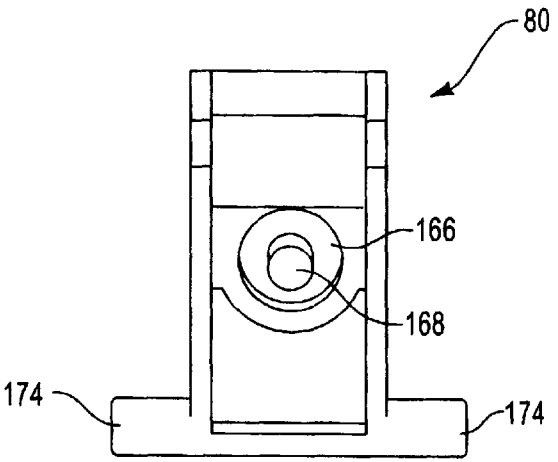
FIG. 15 is a end view of the clamp.

Referring to FIGS. 14–15, the clamp 80 includes a central body 164 having a circular groove 166 around a center post 168 for receiving an end of the biasing spring 90 (see FIG. 13) in order to hold the spring in compression against a pin 170 on a rear wall 172 of the carriage. Pivot posts 174 at the bottom of the clamp fit under wall extensions 176 to provide pivotal rotation around axis 86 as the clamp moves between an open latched position to a closed position. Latching occurs after rearwardly moving the handle to cause the cams 162 to rotatably slide down a cam follower 180 to be seated in a concave notch 178 on the clamp (see FIG. 10A).

Movement of the clamp to the closed position is actuated by rotating the handle forwardly to disengage the cams from the notch, thereby allowing the biasing force of spring 90 to push the clamp (and the handle) toward the print cartridge in a smooth controlled movement as cams 162 ride up a smooth surface 179 of the cam follower 180. When a flat protruding contact surface 182 on the central body 164 makes contact with a laterally extending ridge-like rib 184 located on a lower back portion of the print cartridge, the pivotal movement of the clamp as well as the partially downward facing contact surface creates a strong forward and partially downward clamping force against the print cartridge (see FIG. 10B).

Figure 9:
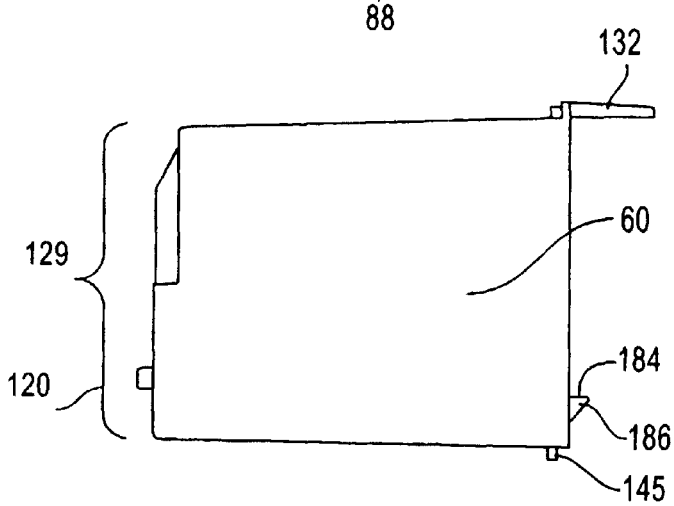
FIG. 9 is a side view of the print cartridge of FIG. 8.

In this regard, by extending the rib 184 at least half and preferably almost the full width along the back of the cartridge and providing a downwardly angled shelf-like support 186 under the rib (see FIGS. 8–9), the clamping force caused by the biasing spring is not focused on one spot but instead is transmitted from the full length of the reinforced rib to pass through the walls of the print cartridge thereby minimizing excessive deflection of the plastic. In the presently preferred embodiment, a preferred force of about 4.5–5.0 pounds (with about 2.0 pounds of this force absorbed by the cushion members under the flex circuit interconnects) is aimed approximately 15 degrees below horizontal as shown by the line 188 in FIG. 10C. Even though this magnitude of force was found to be optimum, increasing or decreasing variations of such angle and increasing or decreasing the amount of force dependent upon various parameters such as cartridge mass, carriage acceleration, reactive cushion force, # of electrical interconnects, etc., and the like may still achieve to a greater or lesser degree the benefits of the invention as set forth herein.

When the clamp is in such closed position, the handle is in an upright passive position and the handle has eliminated itself as receiving or absorbing any of the applied force from the spring. In this position the handle tab (160) is in a somewhat mating relationship with the tab handle (132) of the print cartridge. However when there is no print cartridge installed in the carriage, a stop ledge 189 on both side walls of the carriage chute prevents the handle and the clamp from moving past the "closed" upright position (see FIGS. 3–4). Furthermore, the stop ledge (189) acts as a guide along with tapered guides 190 on the front wall (see FIG. 5) to facilitate initial and satisfactory completion of the installation prior to moving the clamp into closed locked position.

It will be understood by those skilled in the art that while illustrated embodiments of the invention have been shown and described, changes and variations can be made without departing from the spirit and scope of the invention as set forth in the following claims:

We claim as our invention:

1. A printer carriage for removably holding a print cartridge, comprising:

a chute forming a cavity with a top opening, a floor, a front wall and a back wall;

a datum set on the front wall for engaging a corresponding forward area on the print cartridge;

a set of support guides on the floor for engaging a corresponding bottom area on the print cartridge; and a clamp in a rear portion of the chute and movable between an open position which allows manual insertion and removal of the print cartridge from the chute and a closed position which securely holds the print cartridge in the chute against said datum set by applying a clamping force against a back portion of the print cartridge, wherein said clamping force urges said print cartridge toward said floor and said front wall when said clamp is in said closed position.

2. The printer carriage of claim 1 wherein said datum set includes a pair of laterally spaced-apart holes sized and located on said front wall for receiving a matching pair of projections on the print cartridge, such that the projections are securely retained in the spaced-apart holes when said clamp is in said closed position.

3. The printer carriage of claim 1 wherein said datum set includes a flat datum surface for engaging a corresponding front area on the print cartridge, such that the front area is in frictional contact with the flat datum surface when said clamp is in said closed position.

4. The printer carriage of claim 1 wherein said set of support guides includes a pair of spaced-apart raised ledges on a forward portion of said floor adjacent to said front wall.

5. The printer carriage of claim 1 wherein said set of support guides includes a pair of spaced apart raised legs and a central recess on a rearward portion of said floor.

6. The print carriage of claim 1 wherein said datum set is located in said chute to engage the corresponding forward area on a lower half of the print cartridge.

7. The print carriage of claim 1 which further comprises:

a flex circuit located inside of the front wall and having a row of electrical interconnect pads;

a groove located on the inside of the front wall under said pads, said groove enclosed by a raised perimeter; and a compression cushion sized to fit in said groove such that when said clamp is in said closed position, the clamping force applied against the print cartridge in said chute presses the interconnect pads against said cushion causing said cushion to expand laterally against the raised perimeter and create a reactive force facilitating conductive contact through the interconnect pads to the print cartridge.

8. The print carriage of claim 7 which further includes a retainer member having multiple pins sized to pass through matching openings in the flex circuit and the front wall to hold the flex circuit in a predetermined position on the front wall.

9. A printer carriage for removably holding a print cartridge, comprising:

a chute forming a cavity with a top opening, a floor, a front wall and a back wall;

a datum set on the front wall for engaging a corresponding forward area on the print cartridge;

a set of support guides on the floor for engaging a corresponding bottom area on the print cartridge;

a clamp in a rear portion of the chute and movable between an open position which allows manual insertion and removal of the print cartridge from the chute and a closed position which securely holds the print cartridge in the chute against said datum set by applying a clamping force against a back portion of the print cartridge; and a biasing spring coupled to said clamp for biasing said clamp in a forward direction, wherein said clamp is latched in said open position such that when said clamp is unlatched said biasing spring causes said clamp to move all the way from said open position to said closed position.

10. The printer carriage of claim 9 wherein said clamp includes an arm member having a contact surface facing at least partially in a downward direction, wherein said biasing spring causes said contact surface to apply clamping force in forward and downward directions against a ridge on the back portion of the print cartridge when said clamp is in said closed position.

11. A printer carriage for removably holding a print cartridge, comprising:

a chute forming a cavity with a top opening, a floor, a front wall and a back wall;

a datum set on the front wall for engaging a corresponding forward area on the print cartridge;

a set of support guides on the floor for engaging a corresponding bottom area on the print cartridge;

a clamp in a rear portion of the chute and movable between an open position which allows manual insertion and removal of the print cartridge from the chute and a closed position which securely holds the print cartridge in the chute against said datum set by applying a clamping force against a back portion of the print cartridge; and a handle having a cam surface, wherein said clamp includes a cam follower proximate to the cam surface such that actuation of said handle rotates the cam surface back and forth between a lower position latching said cam follower and said clamp in said open position and an upper position unlatching said cam follower and allowing said cam follower and said clamp to move smoothly in the forward direction to said closed position.

12. The print carriage of claim 11 wherein said chute includes a stop member which contacts said handle in said upper position to restrain said handle and said clamp when there is no print cartridge in said chute.

13. A printing system for applying a marking liquid to print media, comprising:

a print carnage having a chute with walls, a floor and an open top, and also having position datums on a front wall and support guides on the floor;

a clamp in a rear portion of said carriage and movable between an open retracted position and a closed non-retracted position, said clamp biased toward said closed position;

a print cartridge with a liquid reservoir and a nozzle plate connected to the reservoir, said print cartridge for mounting in the chute when said clamp is in said open position with said nozzle plate in an upstanding position and exposed for ejecting the marking liquid approximately in a horizontal direction onto the print media; and a handle on said carriage and coupled to said clamp to move said clamp to said closed position to contact a lower back portion of the print cartridge and apply a clamping force in order to securely hold the print cartridge against the position datums after the print cartridge has been mounted in the chute;

wherein said clamp comprises a contact surface for abutting said print cartridge, wherein said contact surface extends at an angle to a surface of said print cartridge when said clamp is in said closed position, said contact surface also engaging a projection extending from said surface of said print cartridge when said clamp is in said closed position.

14. The printing system of claim 13 wherein said carriage includes a plurality of chutes for removably mounting a plurality of print cartridges, respectively.

15. The printing system of claim 13 which further comprises:

a set of signal contacts on said print cartridge; and a flex circuit located inside of a front wall of said chute and having multiple electrical interconnect pads;

wherein said clamp in said closed position applies the clamping force in a forward direction in order to facilitate conductive contact between said signal contacts and said electrical interconnect pads.

16. The printing system of claim 13 wherein said contact surface of said clamp applies a clamping force against said printer cartridge in a forward direction and also at least partially in a downward direction.

17. The printing system of claim 13 which includes motor means connected to said carriage in order to move said carriage across the print media while said print cartridge is ejecting the marking liquid from the nozzle plate onto the print media.

18. The printing system of claim 13 which further includes front and back guides in said chute, and wherein said print cartridge is removably inserted and withdrawn along a primarily vertical path between said guides.

19. The printing system of claim 13 which further comprises:

a spring for biasing said clamp towards said closed position;

said clamp mounted on a first axis in said carriage for pivotal movement between said open position and said closed position; and said handle mounted on a second axis in said carriage such that rotation of said handle controls said pivotal movement of said clamp;

wherein said handle latches said clamp in said open position such that upon rotating said handle to unlatch said clamp, said biasing spring causes said clamp to smoothly pivot to said closed position.

20. The printing system of claim 13 wherein said handle is manually rotatable approximately ninety degrees between a raised vertical position with a grip on said handle extending above said print cartridge when said clamp is in said closed position, and a lowered horizontal latched position extending rearwardly beyond the carriage when said clamp is in said open position.

21. The printing system of claim 13 wherein said chute includes truncated front, back and side walls which extend less than halfway up sides of said print cartridge when said print cartridge is installed in said carriage to allow manual gripping access to said print cartridge, and to leave the nozzle plate exposed for ejecting the marking liquid.

22. A method for installing and operating a print cartridge in a carriage having an open top chute with a set of datums and also electrical interconnect pads located on a front portion of the chute, and support guides located on a floor of the chute, comprising:

providing a clamp in a rear portion of the chute which moves between a retracted rest position and a forward spring biased position;

putting the clamp in the rest position;

inserting the print cartridge with marking liquid into the open top chute to rest against the support guides on the floor;

moving the clamp from the rest position to the forward position in order to apply a clamping force against a back of the print cartridge to securely hold projections on the print cartridge against the datums, and to hold signal pads on the print cartridge in conductive contact with the electrical interconnects;

after putting said clamp fully into said forward position and while said clamp is in said forward position, applying said clamping force with said clamp to urge said print cartridge toward both said front portion and said floor of said chute; and sending signals through the electrical interconnects to the signal pads to activate the print cartridge and eject marking liquid onto print media.

23. The method of claim 22 which further includes:

providing a handle coupled to the clamp for controlling the position of the clamp between the forward position and the rest position;

providing a forward stop on the chute;

pivoting the handle against the forward stop to hold the clamp in a passive forward position when there is no print cartridge installed in the carriage;

pivoting the handle away from the forward stop to place the clamp in the rest position when the print cartridge is being inserted into the chute or is being withdrawn from the chute; and pivoting the handle toward the forward stop to place the clamp in an active forward position applying the clamping force against the print cartridge.

24. The method of claim 23 which includes pivoting the handle away from the forward stop to move the clamp to the rest position and latch the clamp in the rest position.

25. The method of claim 22 wherein said inserting includes positioning the print cartridge in the carriage with a nozzle plate of the print cartridge in an upright position; and expelling marking liquid in an approximately horizontal direction onto print media.

26. The method of claim 22 which includes providing the chute with a front wall, and having datum holes and datum surfaces on the front wall for engagement with the projections on the print cartridge, and having the electrical interconnects carried on the front wall.

27. The method of claim 22 which includes inserting the print cartridge into the open top chute along a primarily vertical path such that after installation the print cartridge protrudes above the open top chute.

28. The method of claim 27 which includes removing the print cartridge from the open top chute along a primarily vertical path.

29. A printer carriage for removably holding a print cartridge, comprising:

a chute with a top opening, a floor, a front wall and a hack wall for receiving a print cartridge, comprising;

a datum set on the front wall for engaging a corresponding forward area on the print cartridge;

a clamp in a rear portion of the chute and movable between an open position which allows insertion and removal of the print cartridge from the chute and a closed position which securely holds the print cartridge in the chute against said datum set;

a flex circuit located inside of the front wall and having a row of electrical interconnect pads;

a groove located on the inside of the front wall under said pads said groove enclosed by a raised perimeter; and a compression cushion in said groove such that when said clamp is in said closed position, the clamping force applied against the print cartridge in said chute presses the interconnect pads against said cushion causing said cushion to expand laterally against the raised perimeter wherein said groove includes expansion space to accommodate the lateral expansion of said cushion;

wherein said clamp includes an arm member having a contact surface for abutting said print cartridge, wherein said contact surface extends at an angle to a surface of said print cartridge when said clamp is in said closed position, said contact surface also engaging a projection extending from said surface of said print cartridge when said clamp is in said closed position.

* * * * *

UNITED STATES PATENT AND TRADEMARK OFFICE

CERTIFICATE OF CORRECTION

PATENT NO. : 6,644,780 B2
DATED : November 11, 2003
INVENTOR(S) : Lodal et al.

It is certified that error appears in the above-identified patent and that said Letters Patent is hereby corrected as shown below:

Column 7,
Line 37, after "print" delete "carnage" and insert therefor -- carriage --

Column 10,
Line 10, after "front wall an a", delete "hack" and insert therefor -- back --.

Signed and Sealed this

Third Day of May, 2005

JON W. DUDAS
*Director of the United States Patent and Trademark Office*